United States Patent [19]

Zentmyer

[11] 4,071,808

[45] Jan. 31, 1978

[54] METHOD AND CIRCUIT FOR OPERATING AN ELECTRICAL FLASH-TUBE

[76] Inventor: John Hobart Zentmyer, 124-F N. Brighton St., Burbank, Calif. 91506

[21] Appl. No.: 705,731

[22] Filed: July 15, 1976

[51] Int. Cl.[2] ..... H05B 41/32

[52] U.S. Cl. ..... 315/241 R; 315/171; 315/173; 315/201; 315/205; 315/241 P

[58] Field of Search ..... 315/200 R, 201, 205, 315/240, 241 P, 241 R, 312, 313, 320, 324, 171, 173; 320/1; 354/132, 143, 145

[56] References Cited

U.S. PATENT DOCUMENTS

| | | | |
|---|---|---|---|
| 3,651,373 | 3/1972 | Ratsch | 315/241 P |

FOREIGN PATENT DOCUMENTS

| | | | |
|---|---|---|---|
| 2,110,752 | 9/1972 | Germany | 315/241 P |
| 1,168,563 | 4/1964 | Germany | 315/241 P |
| 1,111,290 | 7/1961 | Germany | 315/241 P |
| 2,258,834 | 6/1974 | Germany | 315/241 P |

*Primary Examiner*—Eugene R. La Roche
*Attorney, Agent, or Firm*—Harry R. Lubcke

[57] ABSTRACT

A relatively infinitely incremental mode of obtaining any desired brightness of flash from an electrically operable flash-tube is attained by employing plural capacitors, each having a charging source of selectable voltage level and a unilaterally conductive element between the capacitor and the flash-tube. The unilaterally conductive element is poled to pass the charge on the associated capacitor during the discharge cycle regardless of the voltage of the charge on other of the plural capacitors involved.

9 Claims, 2 Drawing Figures

METHOD AND CIRCUIT FOR OPERATING AN ELECTRICAL FLASH-TUBE

BACKGROUND OF THE INVENTION

This invention pertains to electrically powered intense illumination of short duration.

The re-usable flash-tube has been an important item in photography for a number of years. Typically, the brightness of the flash has been fixed, or adjustable in only coarse increments.

Relatively complicated devices have been developed for the exacting demands of professional photography, and circuits have been evolved to accomplish variations in design of the devices.

One design employs an unconventional type of flash-tube having closely spaced electrodes, between which a spark is struck to start the flash. Since the voltage required to produce the spark is many times the voltage that the charge-accumulating capacitor can withstand, a unilateral conductor is employed between the flash-tube and that capacitor. It is poled so that the high sparking voltage cannot be conducted to the capacitor.

Another design employs an electronic counter to successively connect charged capacitors to the flash-tube. The counter is stopped by an automatic, or equivalent, control that determines that enough light has been flashed to handle the photography at hand. Through a multiplexer, successive silicon-controlled-rectifiers are triggered to discharge the number of capacitors required for the given photography. This process is accomplished by external control; not by self control that depends upon the potentials involved.

Still another design employs plural capacitors, but the number of capacitors that will be charged and discharged is selected by a manually operated switch. This allows adjustment of the light flash only in relatively gross steps, rather than incrementally over a wide range.

SUMMARY OF THE INVENTION

Any desired degree of incremental adjustment of the electrical charge impressed upon the flash-tube is possible in the subject invention by the provision of plural charge-carrying capacitors, each with its separate power source of adjustable voltage, and each with a unidirectional conductive device in the circuit between the individual capacitor and the common connection to the flash-tube.

The unidirectionally conductive device makes it possible to have any potential upon any of the capacitors for purpose of adjustment of the light intensity and still to discharge the capacitors into the single flash-tube.

DESCRIPTION OF THE PREFERRED EMBODIMENTS

Figure 1:
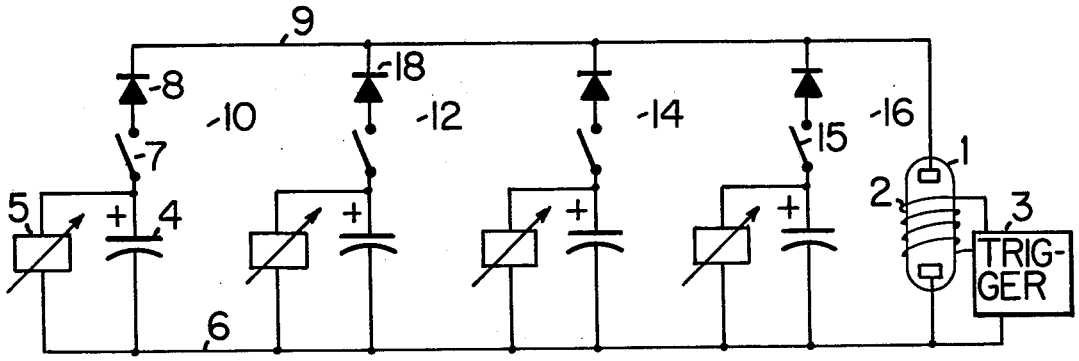
FIG. 1 is a schematic circuit of a typical embodiment of the invention.

In FIG. 1 numeral 1 indicates a triggerable electrical flash-tube. This may be a known type, such as the General Electric FT506, or the G.E. FT120, depending upon the lumens of light output desired.

Independent means for triggering the flash are usually provided. This may be a loosely wound coil 2, of relatively fine wire which is activated by triggering source 3. A high voltage pulse is generated in the source, and when applied to the coil is sufficient to ionize the gas within the tube, usually xenon.

Plural separate capacitors and associated elements are arranged to be connectable to the two electrodes of flash-tube 1. According to the invention the plurality is two, or more. Four are shown in FIG. 1. Each group of elements may be the same, although this is not a requirement according to this invention.

Capacitor 4 may have any value of capacitance and voltage rating insofar as the invention is concerned, but for practical photographic purposes it should have a capacitance of the order of 2,000 microfarads (uf) at a voltage rating of 450 volts. Such capacitors are typically electrolytic and have a polarity, as indicated by the plus sign.

Voltage charging source 5 is connected directly across the terminals of capacitor 4. Chief among the characteristics inuring to this invention is the fact that the voltage output of source 5 is continuously variable. The control knob used to vary the voltage is represented in FIG. 1 by the arrow. It may be calibrated in watt-seconds or *f/* stops as a convenience. The variation need not be from zero voltage, but over a range of on the order of two to one is sufficient.

Source 5 may be powered by an alternating current connection to an electric utility, or by batteries. The batteries may be of the rechargable alkaline or other type.

If the alternating current connection is used the voltage is raised and rectified to give a value slightly less than the rating of the capacitors employed. If batteries are used a known d.c. to d.c. converter is used, which may employ an oscillator.

The negative terminals of the capacitor and of the source are typically connected to a common connection 6.

The positive terminals are connected together and to a switch 7, which may be of the single-pole single-throw type. The switch, in turn, is connected to the anode of a diode 8. The cathode of the same is connected to a second common connection 9. Connections 6 and 9 are connected to the flash terminals of flash-tube 1.

When the first section 10, just recited, is the only one to be used for flashing the tube 2, switch 7 is closed before photographing is about to take place. When trigger element 3 is triggered the flash occurs.

The invention particularly comes into play when two or more sections, such as 10, 12 and 14, are placed in the circuit by the switches of each being closed. Since one section is always required to be connected to the flash electrodes, switch 15 of section 16 may be omitted.

The intensity of the flash is usually measured electrically in watt-seconds. It is adjusted by the operator varying the voltages of the corresponding voltage sources. Assume that he chooses to obtain the full output of one section, say section 10, but only one-half of the output of section 12. The voltage adjustments on each section are set accordingly.

When the voltage of section 10 has been raised to full value while that of section 12 has only been raised to one-half of this value, diode 18 of section 12 is back biased; i.e., it is non-conducting and serves the function of an open switch.

When the flash is triggered the charge first comes from capacitor 4 of first section 10. When this discharge has continued for a very small fraction of a second and the voltage across capacitor 4 has fallen to the voltage of the capacitor of section 12, then diode 18 is no longer back-biased and both capacitors then discharge together until the "complete" discharge of each is accomplished, down to perhaps 70 volts.

It is seen that the same functioning can take place with respect to sections 14 and 16. These may be given any desired charge voltage and will contribute their charge when the voltage on conductor 9 is less than that particular charge voltage. This functioning is automatic.

The charge through flash-lamp 1 may be any value from a maximum where each section is charged to full voltage to a minimum where only one section is partially charged. Any desired increment of charge between these extremes may be had by merely adjusting one or more voltages.

Figure 2:
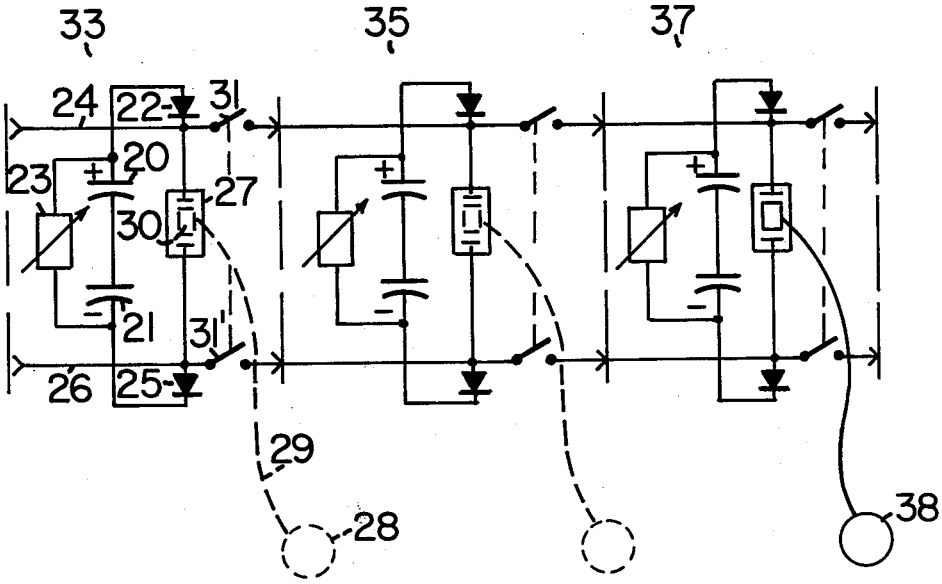
FIG. 2 is a schematic circuit of a more extensive circuit, one that is useful for obtaining greater light output from the flash-tube.

The circuit of FIG. 2 performs essentially the same as the circuit of FIG. 1, but differs in structure.

Capacitors 20 and 21 are essentially the same as prior capacitor 4. Each of capacitors 20 and 21 may have a capacitance of 2,000 uf and a rating of 450 volts; thus giving a capacitance of 1,000 uf and a rating of 900 volts for the pair connected in series.

The anode of diode 22 is connected to the positive terminal of capacitor 20 and voltage charging source 23, while the cathode is connected to common connection bus 24. Similarly, the cathode of diode 25 is connected to the negative terminal of capacitor 21 and voltage charging source 23, while the anode is connected to common connection bus 26.

Buses 24 and 26 are connected to connector 27. An optional flash-lamp 28 is provided with flexible cord, or cable, 29 and mating connector 30. This is for optional insertion into connector 27, thereby forming a single section complete flash-lamp device if this is desired.

Buses 24 and 26 also connect to one terminal each of double-pole single-throw switch 31,31', respectively. This switching arrangement allows electrical isolation of first section 33 from other similar sections to be described. This is essentially the same arrangement as switch 7 in FIG. 1 previously.

Section 35 is a duplicate of previously described section 33, and it with plural sections that the invention is practiced.

Similarly, section 37 is a duplicate of either of the other two sections. Flash-lamp 38, with its flexible two-conductor electrical cord and connector is not considered optional in the three-section embodiment illustrated in FIG. 2. In any arrangement, one flash-lamp is required in order to complete a workable structure, although this may be plugged into any of the sockets 27 desired. Also, more than one flash-lamp is sometimes desired in photography in order to remove shadows or to highlight certain areas of the principal subject. In such an instance additional flash-lamps are inserted in vacant sockets and the over-all charge voltage adjusted to power all lamps at the light output level desired.

Alternately, two flash devices can be obtained by opening a switch, such as 7 or 31,31'. Then a single section provides a nominal light level with one lamp, while the remaining plural-section group provides a high light level with another lamp.

Mechanically, the several sections may be separate. Thus, for a particular task only two sections might be connected electrically and mechanically, while for a larger task perhaps up to six sections might be connected as a practical matter.

In the embodiment of FIG. 2, diodes 22, 25, etc., may be the 1N1188A, available from General Electric. It is required that each of these diodes pass a current of up to several hundred amperes for a very short fraction of a second during the discharge.

Each section of FIG. 2 may have a maximum rating of 400 wattseconds in a typical embodiment.

I claim:

1. The method of variably adjusting the brightness of the flash of an electrical flash tube which comprises the steps of;

a. charging plural capacitors to different electrical potentials, such that the charge on each capacitor is sufficient to produce significant light from said flash tube b. triggering a discharge in an electrical flash-tube, and c. discharging each of said plural capacitors through individual unidirectionally conductive elements into said flash-tube to produce significant light therefrom.

2. A flash-tube electrical circuit, comprising;

a. a triggerable electrical flash-tube (1 or 38), b. plural separate capacitors (4,etc.,20,21,etc.) having comparable capacitances, c. separate means to charge a capacitor (5,etc.,2-3,etc.), individually connected to each said separate capacitor, at least one of said means being variable, and d. separate unidirectionally conductive means (8,etc.,22,25,etc.) individually connected to each said separate capacitor and collectively to said flash-tube, whereby, upon said flash-tube being triggered, each said separate capacitor is discharged through a said unidirectionally conductive means and through said flash-tube.

3. The circuit of claim 2, which additionally includes;

a. a switch (7) connected in series between each said capacitor (4), and a said unidirectionally conductive means (8).

4. The circuit of claim 2, which additionally includes;

a. sectionalized common connector buses (24,26), b. a connection from each said unidirectionally conductive means (22,25,etc.) to a said bus, and c. a switch (31,31',etc.) in circuit between each section of said sectionalized buses.

to accomplish selective electrical disconnection of one section from another.

5. The circuit of claim 4, which additionally includes;

a. an electrical connector (27) connected to each of said common connector buses (24,26) of a said section, and b. a flexible electric cable connectable to said connector, for selectively connecting a said flash-tube (38) thereto.

6. The circuit of claim 5, in which;

a. more than one flash-tube (28,38) is individually connected to more than one electrical connector (27), for simultaneously flashing more than one flash-tube.

7. The circuit of claim 4, in which;

a. the elements of each said section (33,35,37) are rigidly mechanically assembled to allow mechanical separation of said sections.

8. The circuit of claim 4, in which;

a. each said capacitor is comprised of plural capacitors (20,21) connected in series, and b. said separate means to charge a capacitor (23) is connected across both of said plural capacitors (20,21).

9. The circuit of claim 2, in which;

a. each of said separated means to charge (5, etc.) a capacitor is structured to allow essentially continuously variable adjustment of output voltage.

* * * * *